US010775731B2

(12) United States Patent
Kakishima et al.

(10) Patent No.: US 10,775,731 B2
(45) Date of Patent: Sep. 15, 2020

(54) IMAGE FORMING APPARATUS AND FOIL-PRINTED IMAGE FORMING APPARATUS

(71) Applicant: FUJI XEROX CO., LTD., Tokyo (JP)

(72) Inventors: Aya Kakishima, Kanagawa (JP); Yuki Nagamori, Kanagawa (JP); Kunihiko Sato, Kanagawa (JP); Mitsuhiro Matsumoto, Kanagawa (JP); Keitaro Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/520,607

(22) Filed: Jul. 24, 2019

(65) Prior Publication Data

US 2020/0225610 A1 Jul. 16, 2020

(30) Foreign Application Priority Data

Jan. 11, 2019 (JP) ..... 2019-003582

(51) Int. Cl.
*G03G 15/00* (2006.01)
*G03G 15/01* (2006.01)
*G03G 15/20* (2006.01)

(52) U.S. Cl.
CPC ..... *G03G 15/6585* (2013.01); *G03G 15/2014* (2013.01)

(58) Field of Classification Search
CPC ..... G03G 15/6585; G03G 15/2014
See application file for complete search history.

(56) References Cited

U.S. PATENT DOCUMENTS 5,862,434 A * 1/1999 Yamakawa ..... G03G 13/013 399/223
6,605,174 B1 8/2003 Landa et al.
6,977,101 B2 12/2005 Landa et al.
2005/0214669 A1* 9/2005 Hayashi ..... G03G 15/6585 430/109.4
2012/0237698 A1* 9/2012 Funahashi ..... G03G 7/0053 428/32.6

FOREIGN PATENT DOCUMENTS

JP 55-064252 A 5/1980
JP 2003-529460 A 10/2003
JP 2017-223734 A 12/2017

OTHER PUBLICATIONS

Machine translation of JP 2017-223734 A (published on Dec. 21, 2017).*

* cited by examiner

*Primary Examiner* — Sophia S Chen
(74) *Attorney, Agent, or Firm* — Sughrue Mion, PLLC

(57) ABSTRACT

An image forming apparatus includes a first image forming unit that forms a first toner layer on a medium on which an image is to be formed, a foil layer forming unit that forms a foil layer on the first toner layer on a surface of the medium on which an image is to be formed, and a second image forming unit that forms a second toner layer below the foil layer on the surface of the medium, on which an image is to be formed, in such a manner as to compensate for image steps that are formed by the first toner layer.

8 Claims, 8 Drawing Sheets

IMAGE FORMING APPARATUS AND FOIL-PRINTED IMAGE FORMING APPARATUS

CROSS-REFERENCE TO RELATED APPLICATIONS

This application is based on and claims priority under 35 USC 119 from Japanese Patent Application No. 2019-003582 filed Jan. 11, 2019.

BACKGROUND

(i) Technical Field

The present disclosure relates to an image forming apparatus and a foil-printed image forming apparatus.

(ii) Related Art

The method described in Japanese Unexamined Patent Application Publication (Translation of PCT Application) No. 2003-529460 for forming a printed image having a foil-printed portion includes printing at least a portion of the image with a toner, printing a portion of the image that is to be foil printed with a foil adhesive used for affixing foil on a printing foil to the portion, the foil adhesive having a melting temperature lower than the melting temperature of the toner, pressing the printing foil against the image, and heating the printing foil to a temperature that is higher than the melting temperature of the foil adhesive and lower than the melting temperature of the toner.

SUMMARY

Aspects of non-limiting embodiments of the present disclosure relate to obtaining an image forming apparatus capable of suppressing formation of image steps in the region of a foil-printed image, whereas in an image forming apparatus that forms a foil-printed image by uniformly superposing a second toner layer onto a first toner layer and then superposing a foil layer on the upper layer, formation of image steps in the region of the foil-printed image is not suppressed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a first image forming unit that forms a first toner layer on a medium on which an image is to be formed, a foil layer forming unit that forms a foil layer on the first toner layer on a surface of the medium on which an image is to be formed, and a second image forming unit that forms a second toner layer below the foil layer on the surface of the medium, on which an image is to be formed, in such a manner as to compensate for image steps that are formed by the first toner layer.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
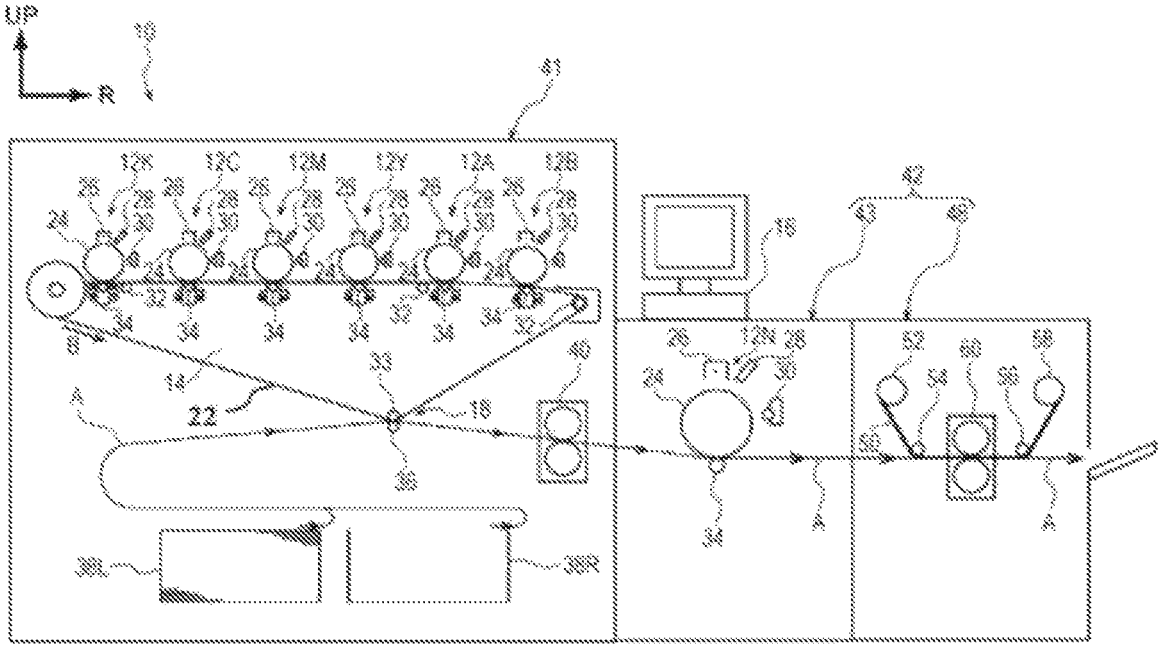
FIG. 1 is a front view illustrating an image forming apparatus according to a first exemplary embodiment.

An example of an image forming apparatus according to a first exemplary embodiment of the present disclosure (hereinafter simply referred to as "apparatus" as appropriate) and an example of a guide member according to the first exemplary embodiment will be described with reference to FIG. 1 and FIGS. 2A to 2D. Note that arrow UP that is illustrated in the drawings indicates the vertical direction, which is a direction toward the upper side of the apparatus. As illustrated in FIG. 1, arrow R indicates the horizontal direction and points toward the right-hand side when the apparatus is viewed from the front. In the following description, when a top and bottom directions are mentioned without any premises, the top and bottom directions refer to the height direction of the apparatus illustrated in FIG. 1. In addition, in the following description, when a transverse direction is mentioned without any premises, the transverse direction refers to the left (L) and the right (R) directions when the apparatus illustrated in FIG. 1 is viewed from the front. Furthermore, in the following description, when a depth direction (i.e., directions toward the near side and the far side) is mentioned without any premises, the depth direction refers to a depth direction when the apparatus illustrated in FIG. 1 is viewed from the front.

[Overall Configuration of Image Forming Apparatus 10]

The configuration of an image forming apparatus 10 will be described first. FIG. 1 is a schematic front view of the image forming apparatus 10 according to the present exemplary embodiment.

As illustrated in FIG. 1, the image forming apparatus 10 includes an image forming section 41 and a foil-printed image forming apparatus 42. The image forming section 41 is positioned on an upstream side in a direction in which a transport path A for a sheet P extends. The sheet P corresponds to a medium, and an image is to be formed on the sheet P. The foil-printed image forming apparatus 42 is positioned on a downstream side in the direction in which the transport path A extends.

The image forming apparatus 10 further includes image forming units 12 each of which employs an electrophotographic system and forms an image, an intermediate transfer belt 22 that holds a formed image, and an intermediate transfer unit 14 on which the intermediate transfer belt 22 is mounted in such a manner as to be supported by the intermediate transfer unit 14. In addition, in the image forming apparatus 10, a second transfer roller 36 that is used for transferring an image from the intermediate transfer unit 14 to the sheet P, on which an image is to be recorded, is disposed in a second transfer region 18 that is located on the lower side of the intermediate transfer unit 14.

In the second transfer region 18, toner images that are formed by the image forming units 12 are transferred onto a surface of the sheet P via the intermediate transfer belt 22, which is mounted on the intermediate transfer unit 14.

(Image Forming Section)

The image forming section 41 includes the plurality of image forming units 12 that form different color toner layers. In the present exemplary embodiment, the plurality of image forming units 12 includes a total of four image forming units 12, which are an image forming unit 12Y, an image forming unit 12M, an image forming unit 12C, and an image forming unit 12K that respectively correspond to yellow (Y), magenta (M), cyan (C), and black (K), an image forming unit 12A, and an image forming unit 12B. The image forming unit 12A and the image forming unit 12B correspond to colors other than the above-mentioned colors. In the present exemplary embodiment, the image forming unit 12A is configured to form a clear image, and the image forming unit 12B is configured to form a white image.

In the present exemplary embodiment, Y, M, C, and K are fundamental colors for outputting a color image. In contrast, clear (CL) and white (W) serve as additional colors and each play a selective role to add a special appearance to an image. Thus, the clear image forming unit 12A and the white image forming unit 12B may correspond to other colors (e.g., special colors such as gold, silver, red, blue, green, gray, the color of a clear toner with high gloss, and the color of a clear toner with low gloss). Here, the term "gloss" refers to the degree of gloss of a surface of a formed image, and the gloss may be measured by, for example, a gloss meter. Note that, in the following description, when it is not necessary to distinguish the image forming units 12 in terms of color, reference signs "A", "B", "Y", "M", "C", and "K" that are given to the image forming units 12 and that denote the corresponding colors may sometimes be omitted, and the image forming units will be simply referred to as "image forming units 12".

The image forming units 12 for the corresponding colors are configured in a similar manner except with regard to the toners that are used in the image forming units 12. As illustrated in FIG. 1, each of the image forming units 12 includes a cylindrical photoconductor 24 that rotates and a charger 26 that charges the photoconductor 24. Each of the image forming units 12 further includes an exposure device 28 that radiates exposure light onto the photoconductor 24, which has been charged, so as to form an electrostatic latent image and a developing device 30 that develops the electrostatic latent image into an image, which is formed of a toner layer, with a developer including a toner.

Each of the photoconductors 24 is configured to be capable of making contact with the intermediate transfer belt 22, which will be described later. As illustrated in FIG. 1, the image forming unit 12A, the image forming unit 12B, the image forming unit 12Y, the image forming unit 12M, the image forming unit 12C, and the image forming unit 12K, which respectively correspond to clear, white, yellow, magenta, cyan, and black, are arranged in this order starting from an upstream side in a direction in which the intermediate transfer belt 22 moves circularly (i.e., the direction of arrow B in FIG. 1).

Note that an image that is formed of toner images formed by the image forming units 12 in the image forming section 41 will be suitably referred to as "fundamental image" so as to be distinguished from an image that is formed by an adhesive-toner supply unit 43, which will be described later. In addition, the toners that are used by the image forming units 12 will be suitably referred to as "fundamental toners" so as to be distinguished from an adhesive toner that is supplied in the adhesive-toner supply unit 43, which will be described later. Here, toner images that are formed by using the fundamental toners each correspond to an example of a first toner layer.

(Intermediate Transfer Unit 14)

The intermediate transfer unit 14 includes first transfer rollers 34 that are disposed in such a manner as to face the image forming units 12 for the corresponding colors and a backup roller 33 that is disposed in such a manner as to face the second transfer roller 36. Note that details of the second transfer roller 36 will be described later.

(Intermediate Transfer Belt 22)

As illustrated in FIG. 1, the intermediate transfer belt 22 has an endless loop shape. The intermediate transfer belt 22 is wound around and positioned by a plurality of rollers 32. In the present exemplary embodiment, when viewed from the front, the intermediate transfer belt 22 is positioned in such a manner as to form the shape of a substantially obtuse triangle that is elongated in a width direction of the apparatus and that has a corner with an obtuse angle pointing downward. One of the plurality of rollers 32 that is not illustrated in FIG. 1 has a function of causing the intermediate transfer belt 22 to rotate in the direction of arrow B by the power of a motor (not illustrated). The intermediate transfer belt 22 transports an image that has been transferred in a first transfer process to the intermediate transfer belt 22 toward the second transfer region 18 by rotating in the direction of arrow B.

The intermediate transfer belt 22 is configured to be capable of moving circularly in the direction of arrow B while being in contact with or spaced apart from the photoconductors 24 for the corresponding colors.

(First Transfer Region)

As illustrated in FIG. 1, first transfer regions are each formed of a portion where one of the photoconductors 24, the intermediate transfer belt 22, and one of the first transfer rollers 34 are in contact with one another. As illustrated in FIG. 1, the first transfer rollers 34 are disposed in such a manner as to face the photoconductors 24 with the intermediate transfer belt 22 interposed therebetween. Each of the first transfer rollers 34 and the intermediate transfer belt 22 are in contact with each other under a predetermined load. Specifically, the portions where the first transfer rollers 34 and the intermediate transfer belt 22 are in contact with each other correspond to the first transfer regions.

A voltage is applied to the first transfer rollers 34 by a power supplying unit (not illustrated). This voltage is a first transfer voltage for transferring (in the first transfer process) toner images that are formed on the photoconductors 24 onto the intermediate transfer belt 22 between the photoconductors 24 and the first transfer rollers 34.

(Second Transfer Region)

As illustrated in FIG. 1, the second transfer region 18 is formed of a portion where the intermediate transfer belt 22 and the second transfer roller 36 are in contact with each other. The intermediate transfer belt 22 is caused to be in contact with the second transfer roller 36 under a predetermined load by the backup roller 33, which is disposed in such a manner as to face the second transfer roller 36. Specifically, the portion where the intermediate transfer belt 22 and the second transfer roller 36 are in contact with each other corresponds to the second transfer region 18.

A voltage is applied to the second transfer roller 36 by a power supplying unit (not illustrated). This voltage is a second transfer voltage for transferring (in a second transfer process) toner images that have been transferred to the intermediate transfer belt 22 in such a manner as to be superposed with one another onto the sheet P that is transported to the second transfer region 18.

(Fixing Device)

A fixing device 40 is disposed downstream from the second transfer region 18 in a direction in which the sheet P is transported (hereinafter referred to as "sheet-transport direction"). The fixing device 40 includes a pair of rollers that face each other. The pair of rollers are arranged in such a manner as to face each other with the transport path A interposed therebetween. In other words, the sheet P to which an image is to be fixed is transported so as to pass between the pair of rollers.

(Sheet Transport Path)

The transport path A, which is illustrated in FIG. 1, has a function of transporting the sheet P that is prepared beforehand in a sheet tray 38R or a sheet tray 38L. Specifically, the transport path A is provided with a plurality of sheet-transport rollers (not illustrated). As a result, the sheet P is transported along the transport path A so as to pass sequentially through the second transfer region 18 and the fixing device 40.

(Fundamental-Image Forming Operation)

An overview of an image forming operation that is performed on the sheet P in the image forming section 41 will now be described.

Upon reception of an image formation command, a control device 16 causes the image forming units 12 to operate. The photoconductors 24 for the corresponding colors are charged by the corresponding chargers 26 while the photoconductors 24 are rotating. The control device 16 sends image data, which has undergone image processing performed by an image-signal processing unit (not illustrated), to each of the exposure devices 28. The exposure devices 28 expose the corresponding photoconductors 24, which have been charged, to light by radiating the exposure light onto the photoconductors 24 in accordance with the image data. As a result, electrostatic latent images are formed on the outer peripheral surfaces of the photoconductors 24. The electrostatic latent images formed on the photoconductors 24 are developed by the corresponding developing devices 30, and toner images of the different colors are formed onto the photoconductors 24 for the corresponding colors.

The different color toner images, which have been formed on the photoconductors 24 for the corresponding colors, are transferred in the first transfer process onto the intermediate transfer belt 22 by the first transfer rollers 34 for the corresponding colors in the first transfer regions. In this case, as a result of the intermediate transfer belt 22 moving circularly, the different color toner images are sequentially transferred onto the intermediate transfer belt 22 in the first transfer process while being superposed with one another. The toner images that have been superposed with one another in this manner are transported to the second transfer region 18 as a result of the intermediate transfer belt 22 moving circularly. Then, the toner images, which have been superposed with one another, are transferred onto the sheet P from the intermediate transfer belt 22 in the second transfer region 18.

The sheet P to which the toner images have been transferred in the second transfer process is transported toward the fixing device 40. In the fixing device 40, a surface (hereinafter suitably referred to as "front surface") of the sheet P on which the toner images have been formed is heated and pressurized by a fixing belt, and the other surface (hereinafter suitably referred to as "rear surface") of the sheet P that is opposite to the surface of the sheet P on which the toner images have been formed is heated and pressurized by a fixing roller. As a result, the toner images formed by the image forming units 12 are fixed onto the sheet P.

[Configuration of Principal Portion]

The configuration of a principal portion in the present exemplary embodiment will now be described.

(Foil-Printed Image Forming Apparatus 42)

As illustrated in FIG. 1, the foil-printed image forming apparatus 42 is disposed downstream from the image forming section 41 in the sheet-transport direction. The foil-printed image forming apparatus 42 includes the adhesive-toner supply unit 43 and a foil fixing unit 48.

(Adhesive-Toner Supply Unit 43)

The adhesive-toner supply unit 43 includes an image forming unit 12N that is used for supplying an adhesive toner and a first transfer roller 34. Regarding the configuration of the image forming unit 12N and an image forming operation that is performed by the image forming unit 12N, the image forming unit 12N employs an electrophotographic system like the image forming units 12 in the image forming section 41, and thus, components similar to the components included in the image forming units 12 are denoted by the same reference signs, and descriptions of the components and their operations will be omitted.

A toner layer that is formed by the image forming unit 12N using the adhesive toner (hereinafter suitably referred to as "adhesive toner layer") is directly transferred onto the sheet P in a first transfer process by a voltage that is applied to the first transfer rollers 34. As a result, the adhesive toner layer is formed on the top layer of the fundamental image. Here, the adhesive toner layer corresponds to an example of a second toner layer.

The adhesive toner layer formed by the image forming unit 12N is formed by using a toner having a melting point lower than each of the melting points of the toners that are used for forming the fundamental image in the image forming section 41. In addition, this toner with a low melting point does not include pigment and wax (i.e., oil) that are included in a normal toner.

Figure 2A:
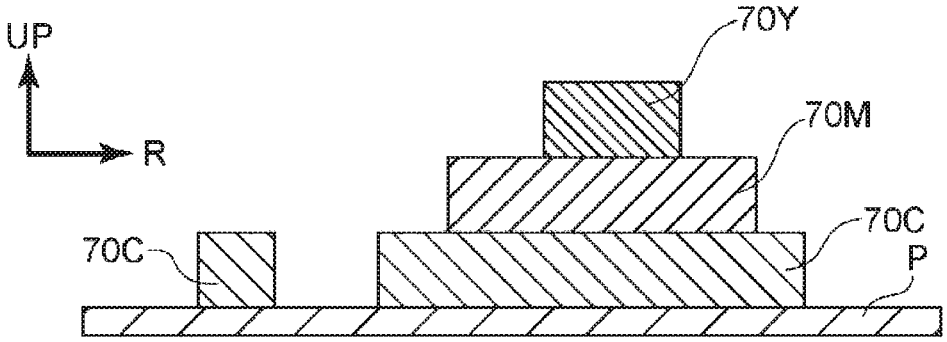
FIGS. 2A to 2D are side views schematically illustrating a foil-printed image that is formed in the image forming apparatus according to the first exemplary embodiment and a comparative example.

As illustrated in FIG. 2A, in the fundamental image, the toner layers formed by the image forming units 12 are stacked on top of one another. Thus, variations in the total height of the toner layers occur in accordance with the design of the image to be formed.

Figure 2B:
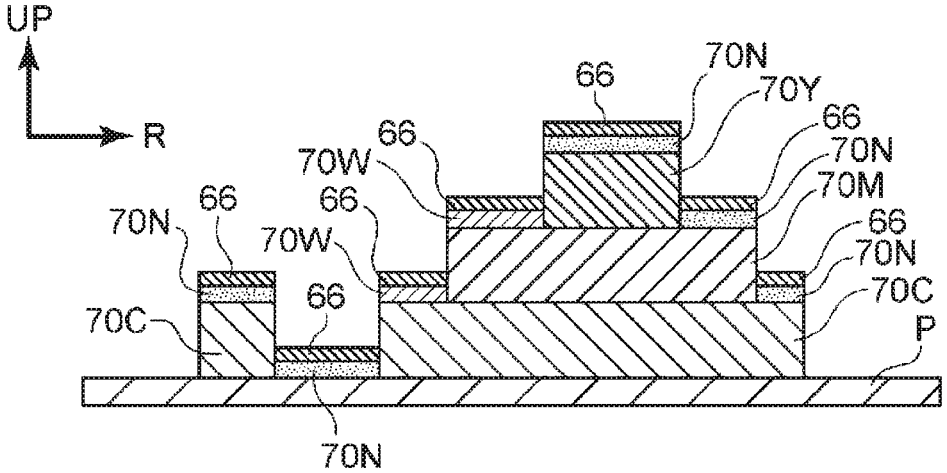
Figure 2C:
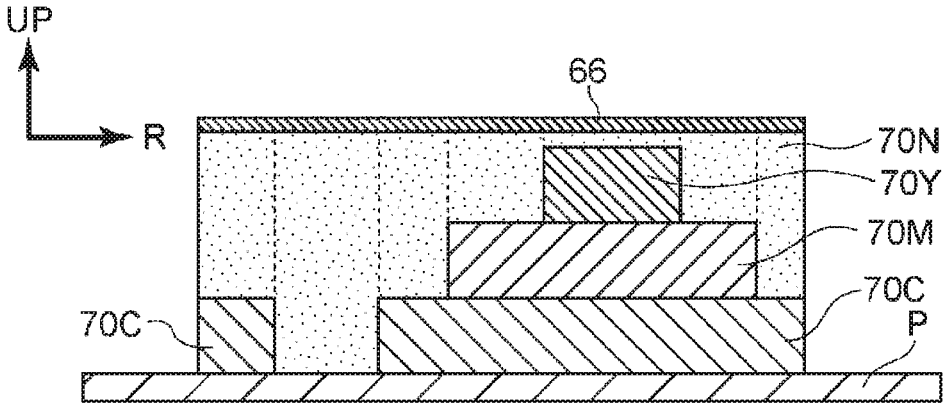

As illustrated in FIG. 2C, an adhesive toner layer 70N in the present exemplary embodiment is formed so as to compensate for the variations in the height of the fundamental image. Here, the variations in the height of the fundamental image are compensated by varying the stacking amount of the adhesive toner layer 70N that is superposed on the fundamental image. Specifically, the output of the exposure device 28 in the adhesive-toner supply unit 43 is adjusted, so that the amount of the toner to be supplied is adjusted. In other words, such reduction in variations in the sum of the height of the fundamental image and the height of the adhesive toner layer 70N will be referred to as "compensation".

Note that information that is required for the compensation (i.e., information regarding the height of the adhesive toner layer 70N) is acquired from image information that is input to the image forming units 12 in order to form the fundamental image. Note that the control device 16 (see FIG. 1) acquires the image information of the fundamental image and information regarding formation of the adhesive toner layer 70N and performs control of the image forming unit 12N, which is used for supplying the adhesive toner.

(Foil Fixing Unit 48)

As illustrated in FIG. 1, the foil fixing unit 48 includes a feed roller 52, an upstream roller 54, a downstream roller 56, a collecting roller 58, and a second fixing device 60. The feed roller 52 and the upstream roller 54 are arranged upstream from the second fixing device 60 in the sheet-transport direction. The downstream roller 56 and the collecting roller 58 are arranged downstream from the second fixing device 60 in the sheet-transport direction.

The feed roller 52 and the upstream roller 54 form a feeding unit that feeds a foil sheet 50.

The downstream roller 56 and the collecting roller 58 form a removing unit that removes the foil sheet 50.

The foil sheet 50 is wound around the feed roller 52. The foil sheet 50 is extended from the feed roller 52 and fed to the upstream roller 54, the downstream roller 56, and the collecting roller 58 in this order. In addition, the foil sheet 50 fed to the collecting roller 58 is collected as a result of being wound around the collecting roller 58.

The foil sheet 50 is disposed along the transport path A between the upstream roller 54 and the downstream roller 56. Specifically, the foil sheet 50 is disposed between the upstream roller 54 and the downstream roller 56 in such a manner that a foil layer 66 (details will be described later) is superposed on the surface of the sheet P on which an image has been formed, the sheet P being transported along the transport path A. In addition, the foil sheet 50 is disposed in such a manner as to pass through, together with the transport path A, a fixing nip of the second fixing device 60 between the upstream roller 54 and the downstream roller 56. Specifically, the foil sheet 50 and the transport path A are arranged in such a manner as to pass between a pair of rollers that are included in the second fixing device 60.

(Second Fixing Device 60)

As illustrated in FIG. 1, the second fixing device 60 includes the pair of upper and lower rollers that are arranged in such a manner as to face each other with the transport path A and the foil sheet 50 interposed therebetween. The upper roller and the lower roller are pressed against each other under a constant load.

The upper roller is equipped with a built-in halogen lamp, which is not illustrated. As a result, the upper roller is heated such that the temperature of a surface thereof reaches a desired fixing temperature.

The lower roller is heated by the upper roller via the foil sheet 50 or via the foil sheet 50 and the sheet P.

(Foil Sheet 50)

Figure 3:
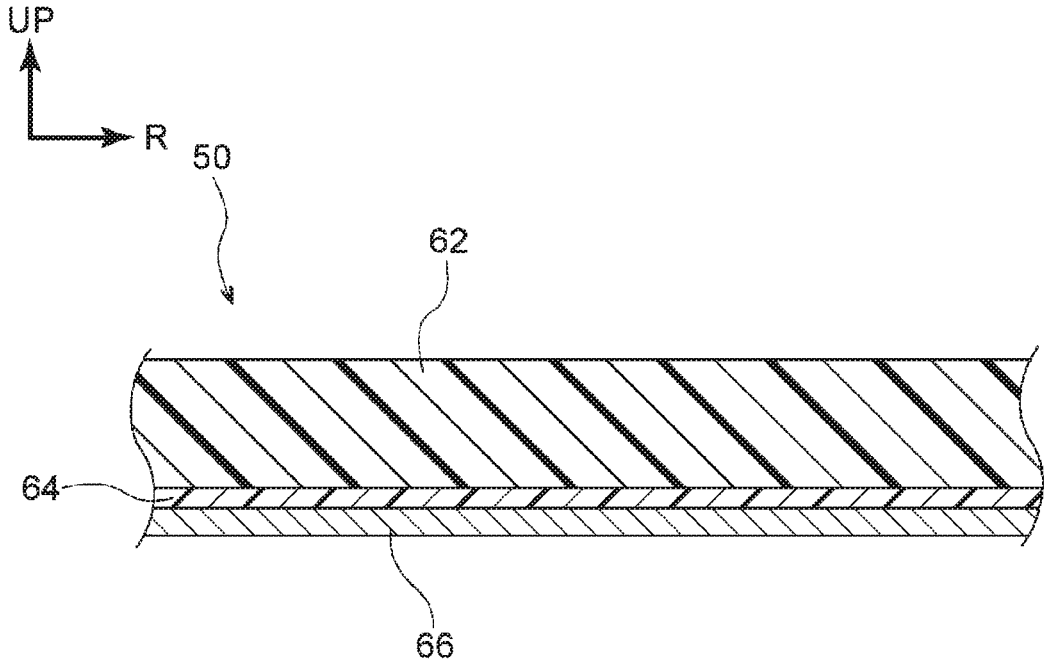
FIG. 3 is a front view illustrating a foil sheet that is used in the image forming apparatus according to the first exemplary embodiment.

As illustrated in FIG. 3, the foil sheet 50 includes a base member 62, an adhesive layer 64, and the foil layer 66 that are stacked on top of one another. Specifically, the foil layer 66 is held in a state of being stacked on a surface of the base member 62 with the adhesive layer 64 interposed therebetween by the adhesive force of the adhesive layer 64.

The base member 62 is made of a resin including polyethylene terephthalate (PET) and is in the form of a sheet. The adhesive layer 64 is formed by applying, to the base member 62, a resin material that is softened and whose adhesive force decreases as a result of being heated into the form of a layer. As an example, the foil layer 66 is formed of a layer of foil including aluminum.

(Foil-Printed Image Forming Operation)

A foil-printed image forming operation that is performed in the foil-printed image forming apparatus 42 will now be described.

In the adhesive-toner supply unit 43, the adhesive toner layer 70N is formed onto the upper layer of the fundamental image, which has been formed on the sheet P, by the image forming unit 12N that employs an electrophotographic system.

In the foil fixing unit 48, the foil layer 66 is transferred onto a portion of the sheet P to which the adhesive toner has been supplied by the adhesive-toner supply unit 43. The portion to which the foil layer 66 has been transferred becomes a foil-printed image.

The foil sheet 50 is superposed on the sheet P, which has been transported along the transport path A, by the feeding unit, and after the sheet P has passed through the second fixing device 60, the foil sheet 50 is removed by the removing unit.

The sheet P, on which the foil sheet 50 has been superposed, is heated and pressurized by the fixing roller when the sheet P passes through the second fixing device 60. In this case, the foil layer 66 of the foil sheet 50 adheres to a portion of the sheet P where the adhesive toner has been provided between the foil sheet 50 and the sheet P. In addition, the foil layer 66 is not press-bonded to a portion of the sheet P where the adhesive toner is not provided between the foil sheet 50 and the sheet P, and the foil layer 66 is removed with the foil sheet 50 from the sheet P by the removing unit. In this manner, a foil-printed image is formed by causing the sheet P to have a portion to which the foil layer 66 is transferred and a portion to which the foil layer 66 is not transferred.

Operations and Effects

Operations and effects of the present exemplary embodiment will now be described.

In the image forming section 41, toner images that are formed by the image forming units 12 are transferred onto the sheet P. Then, in the adhesive-toner supply unit 43, the adhesive toner is supplied to a desired portion of the sheet P. In addition, in the foil fixing unit 48, a foil-printed image is formed on the portion of the sheet P to which the adhesive toner has been supplied.

As illustrated in FIG. 2A, when the fundamental toner layers are formed on the sheet P, in the fundamental image formed by the image forming section 41, the toner layers that are formed by using color toners (e.g., a yellow toner layer 70Y, a magenta toner layer 70M, and a cyan toner layer 70C in this case) are stacked on top of one another. Accordingly, variations in the total height of the toner layers occur in accordance with the design of the image to be formed. Thus, when the adhesive toner layer 70N and the foil layer 66 are uniformly formed on the fundamental image, variations in the height of the foil layer 66 corresponding to the variations in the height of the fundamental image occur as illustrated in FIG. 2B. The variations in the height of the foil layer 66 will hereinafter be referred to as "image steps" as appropriate.

The foil layer 66 is likely to have metallic luster and gloss stronger than those of the fundamental image. Consequently, when image steps are generated in the foil-printed image as illustrated in FIG. 2B, the image steps are more noticeable than image steps that are generated in the fundamental image.

Accordingly, as illustrated in FIG. 2C, in the present exemplary embodiment, variations in the height of the fundamental image are compensated by the adhesive toner layer 70N. Note that the adhesive toner layer 70N serves to enable the foil layer 66 to adhere to the color toner layers, and thus, the adhesive toner layer 70N is also stacked on the toner layer 70Y, which is the uppermost layer.

Figure 2D:
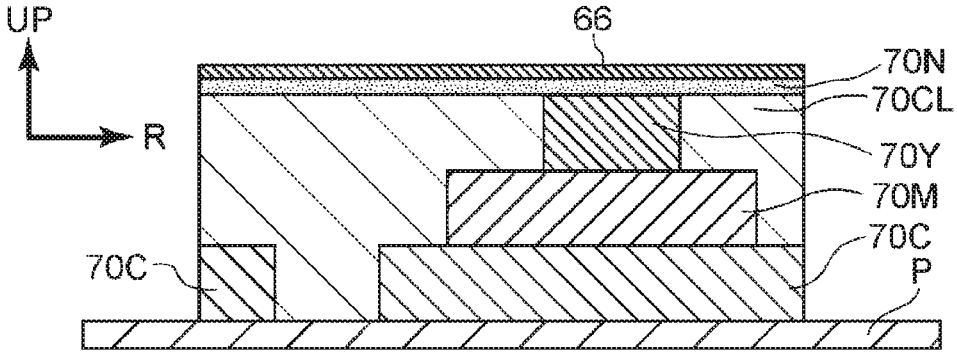

FIG. 2D schematically illustrates a foil-printed image that is formed in a modification of the present exemplary embodiment. In an image forming apparatus according to the modification, when the fundamental image is formed, variations in the total height of toner layers that are formed by using color toners (i.e., Y, M, C, and K toners) are compensated by a clear toner layer 70CL that is formed by using a toner (e.g., white toner) excluding the color toners.

After variations in the height of the fundamental image have been compensated by a clear toner or the like, the adhesive toner layer 70N may be superposed on the fundamental image by using only an amount of the adhesive toner sufficient to form a foil-printed image.

Second Exemplary Embodiment

An image forming apparatus according to a second exemplary embodiment of the present disclosure will be described with reference to FIGS. 4A to 4C. Note that the image forming apparatus according to the second exemplary embodiment is a modification of the image forming apparatus according to the first exemplary embodiment. Thus, the same components will be suitably denoted by the same reference signs, and repeated descriptions will be suitably omitted.

Figure 4A:
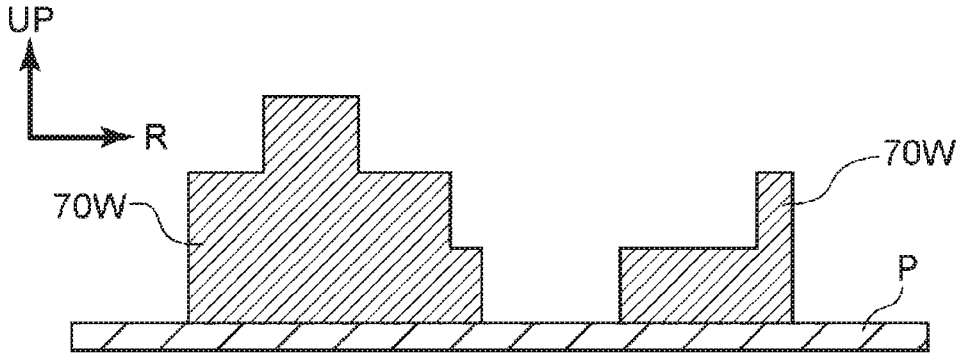
FIGS. 4A to 4C are side views schematically illustrating a foil-printed image that is formed in an image forming apparatus according to a second exemplary embodiment.

As illustrated in FIG. 4A, in the present exemplary embodiment, a toner layer for compensating variations in the height of the fundamental image, the toner layer corresponding to an example of a third toner layer, is formed to be closer to the sheet P than the first toner layers formed by using the color toners (i.e., the toner layer is formed on the lower side of the fundamental image). Note that, as illustrated in FIG. 4B, a white toner layer 70W may be used as the third toner layer as an example.

The first toner layers are stacked on the third toner layer, which is formed on the sheet P. In this case, variations in the height of the fundamental image, which is formed of the third toner layer and the first toner layers, is compensated by the third toner layer.

In the adhesive-toner supply unit 43, the adhesive toner layer 70N (corresponding to an example of the second toner layer) is formed on the first toner layers and the third toner layer. Here, the adhesive toner layer 70N is formed by using a toner having a melting point lower than each of the melting points of the toners of the first toner layers and lower than the melting point of the toner of the third toner layer.

Operations and Effects

Operations and effects of the image forming apparatus according to the second exemplary embodiment will now be described.

Figure 4B:
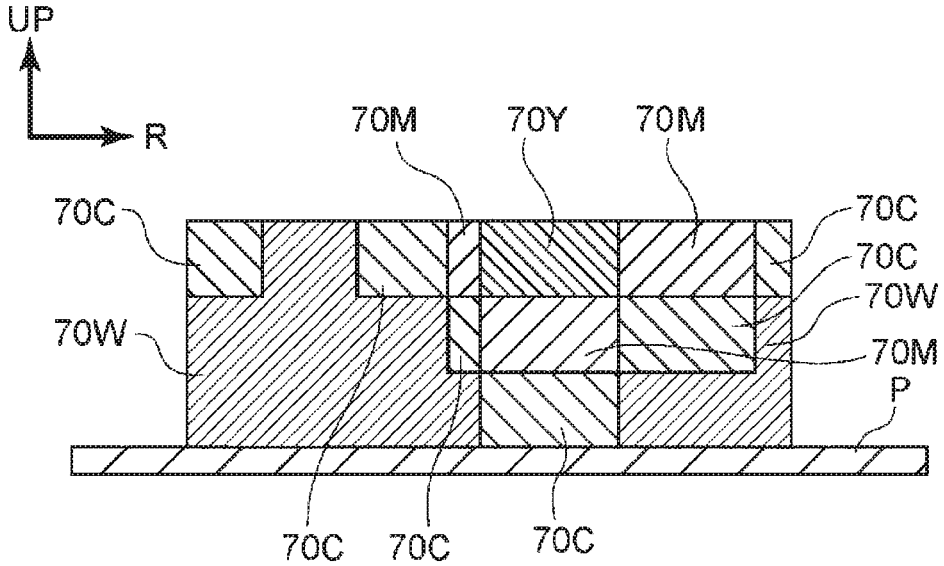

According to the present exemplary embodiment, since the color toner layers are superposed on the third toner layer that is formed beforehand as illustrated in FIG. 4B, variations in the height of the fundamental image, which is formed of the first toner layers and the third toner layer, are reduced.

Figure 4C:
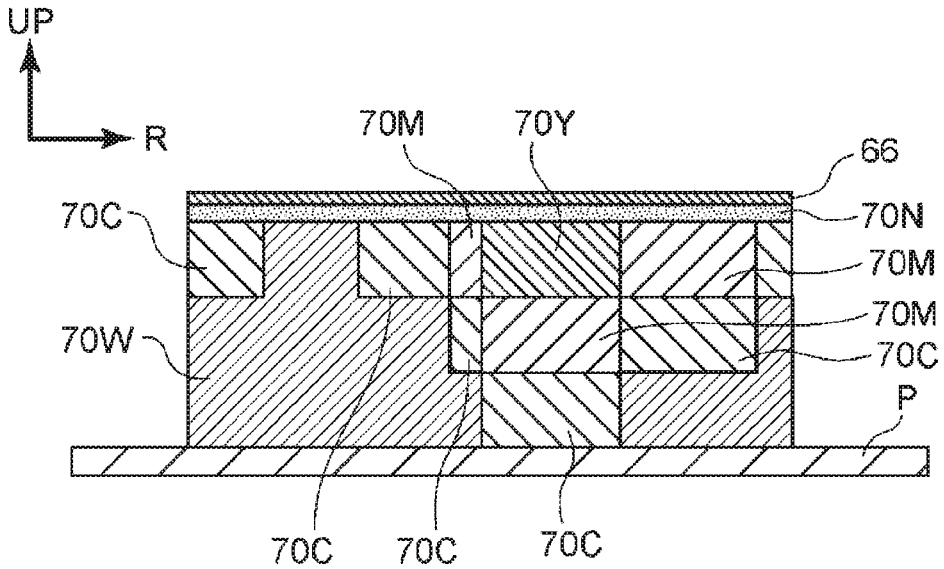

As illustrated in FIG. 4C, according to the present exemplary embodiment, the foil layer 66 is formed on the upper layer of the fundamental image with the adhesive toner layer 70N, which is formed on the fundamental image, interposed therebetween. Since the variations in the height of the fundamental image are reduced, variations in the heights of the adhesive toner layer 70N and the foil layer 66 each formed on the upper layer of the fundamental image are also reduced. In other words, the probability of formation of image steps in the foil layer 66 is reduced.

In the present exemplary embodiment, the third toner layer may be formed by using a toner (e.g., a clear toner or white toner) that is not a color toner.

For example, the third toner layer may be formed by using white toner, and the white toner layer 70W may be formed beforehand on all the portions of the sheet P on which other toner layers are to be formed. In this case, for example, the white toner layer 70W may be formed between the toner layer 70C and the sheet P illustrated in FIG. 4C.

Third Exemplary Embodiment

An image forming apparatus according to a third exemplary embodiment of the present disclosure will be described with reference to FIG. 5A to FIG. 6B. Note that the image forming apparatus according to the third exemplary embodiment is another modification of the image forming apparatus according to the first exemplary embodiment. Thus, the same components will be suitably denoted by the same reference signs, and repeated descriptions will be suitably omitted.

In the present exemplary embodiment, the image forming unit 12A serves as a unit that forms a clear image with high gloss, and the image forming unit 12B serves as a unit that forms a clear image with low gloss.

Figure 5A:
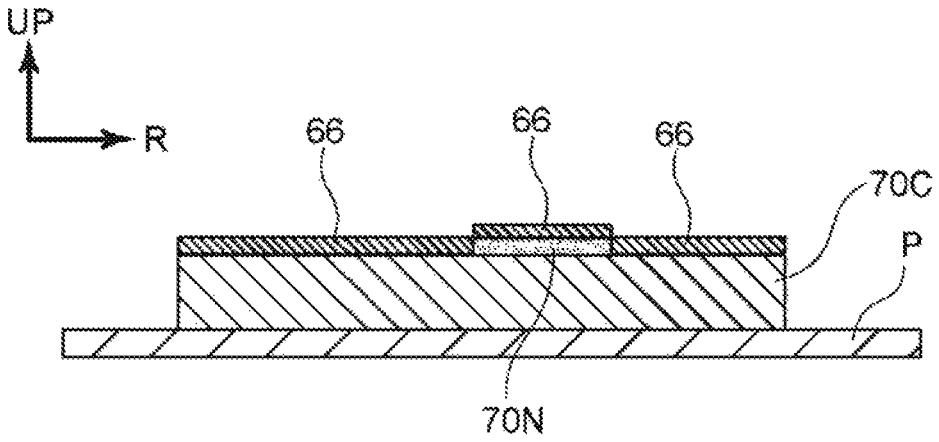
RELATED ART FIG. 5A
FIGS. 5A to 5C are side views schematically illustrating a foil-printed image that is formed in an image forming apparatus according to a comparative example.
Figure 5B:
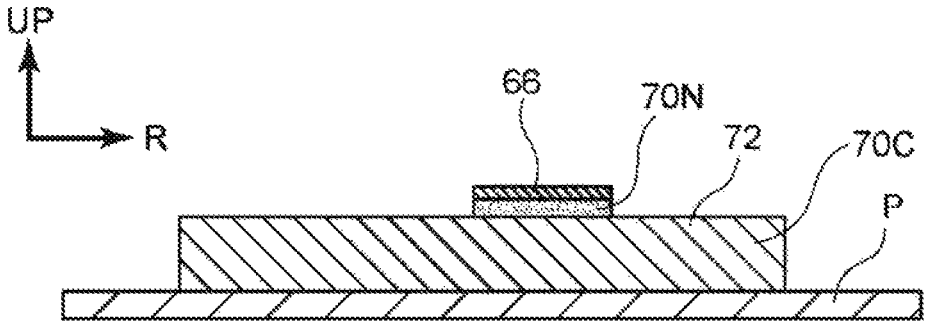
RELATED ART FIG. 5B
Figure 5C:
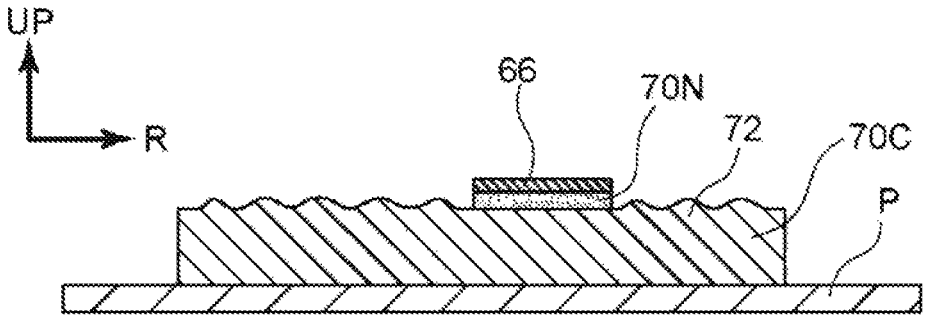
RELATED ART FIG. 5C

A foil-printed image that is formed by an image forming apparatus of a comparative example will now be described with reference to FIG. 5A to FIG. 5C. First, as illustrated in FIG. 5A, in the image forming apparatus of the comparative example, the foil layer 66 of the foil sheet 50 is superposed on a color toner layer (the cyan toner layer 70C is illustrated in FIG. 5A to FIG. 5C as an example of the color toner layer). Note that FIG. 5A to FIG. 5C are schematic diagrams, and thus, the base member 62 and the adhesive layer 64 of the foil sheet 50 are not illustrated. Here, the foil layer 66 of the foil sheet 50 is superposed on a portion of the color toner layer on which the adhesive toner layer 70N is not formed. In addition, the foil sheet 50 is pressed against the sheet P by the second fixing device 60 (see FIG. 1).

Then, as illustrated in FIG. 5B, the base member 62, the adhesive layer 64, and the foil layer 66 excluding a portion of the foil layer 66 that corresponds to the adhesive toner layer 70N are removed with the foil sheet 50.

Here, in the second fixing device 60, a top surface 72 of the color toner layer is pressed against the foil layer 66 while being heated. Thus, the shape of the top surface 72 of the color toner layer is deformed in such a manner as to correspond to the shape of a surface of the foil layer 66 (i.e., the surface roughness of the foil layer 66).

For example, in the case where the surface shape of the foil sheet 50 is smoother than the surface shape of the upper roller of the fixing device 40, the surface shape of the top surface 72 of the color toner layer after the foil layer 66 has been formed on the top surface 72 is smoother than that before the foil layer 66 is formed on the top surface 72. Here, when the surface shape of the top surface 72 of the color toner layer becomes smoother, the gloss of the image that is formed increases. Thus, in the case where the surface shape of the foil sheet 50 is smoother than the surface shape of the upper roller of the fixing device 40, the gloss of the image becomes higher than that before the foil layer 66 is formed on the color toner layer.

As illustrated in FIG. 5A, in the present exemplary embodiment, in such a case, a clear image with low gloss (i.e., a clear toner layer with low gloss) is formed beforehand on the color toner layer. More specifically, in a region of the sheet P on which a foil-printed image is not to be formed, a clear toner layer with low gloss is formed on the color toner layer.

Here, as the clear toner with low gloss, a toner having a viscosity that becomes lower than that of the color toner when the toner is heated to the fixing temperature by the second fixing device 60 may be used.

Alternatively, as the clear toner with low gloss, a toner having a melting point higher than that of the color toner.

In contrast, as illustrated in FIG. 5C, in the case where the shape of a surface of the foil layer 66 of the foil sheet 50, the surface being located on the side on which the sheet P is present, is rougher than the surface shape of the upper roller of the fixing device 40, the surface shape of the top surface 72 of the color toner layer becomes rougher than that before the foil layer 66 is formed on the top surface 72. When the surface shape of the top surface 72 of the color toner layer becomes rough, the gloss of the image is reduced.

For example, when an adhesive or the like that improves the adhesive force of the foil layer 66 of the foil sheet 50 is applied to the surface of the foil layer 66 that is located on the side on which the sheet P is present, the shape of the surface of the color toner layer that is brought into contact with the foil layer 66 is likely to be roughened because of the roughness of the surface shape of the foil layer 66 due to the adhesive. When the surface shape of the top surface 72 of the color toner layer becomes rough, the gloss of the image is reduced.

In the present exemplary embodiment, in such a case, a clear image with high gloss (i.e., a clear toner layer with high gloss) is further formed on the color toner layer. More specifically, in the region of the sheet P on which a foil-printed image is not to be formed, a clear toner layer with high gloss is formed on the color toner layer.

Here, as the clear toner with high gloss, a toner having a viscosity that becomes higher than that of the color toner when the toner is heated to the fixing temperature by the second fixing device 60 may be used.

Alternatively, as the clear toner with high gloss, a toner having a melting point lower than that of the color toner.

Here, regarding selection of the clear toner with low gloss or the clear toner with high gloss as the toner to be used, the control device 16 determines the characteristics of the foil sheet 50, which is used in the foil fixing unit 48, (i.e., the surface shape of the foil layer 66 or whether the foil layer 66 is provided with an adhesive).

Specifically, a sensor (not illustrated) that measures the gloss of the sheet P is disposed downstream from the second fixing device 60 in the sheet-transport direction, and the gloss of the color toner layer on the sheet P is measured by the sensor. The control device 16 controls the image forming unit 12A and the image forming unit 12B in such a manner that the clear toner with high gloss is selected when the gloss measured by the sensor is equal to or higher than a predetermined value and that the clear toner with low gloss is selected when the gloss measured by the sensor is equal to or lower than the predetermined value. Here, the predetermined value is set beforehand in accordance with the characteristic (appearance) of the foil sheet 50 that is used.

Operations and Effects

Operations and effects of the image forming apparatus according to the third exemplary embodiment will now be described.

Figure 6A:
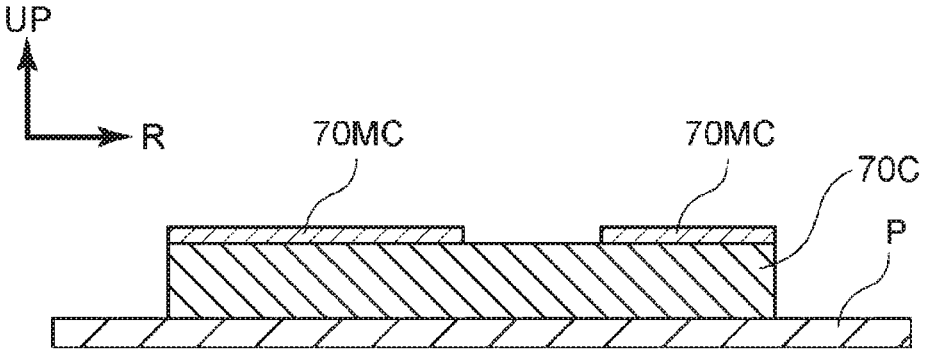
FIGS. 6A and 6B are side views schematically illustrating a foil-printed image that is formed in an image forming apparatus according to a third exemplary embodiment.
Figure 6B:
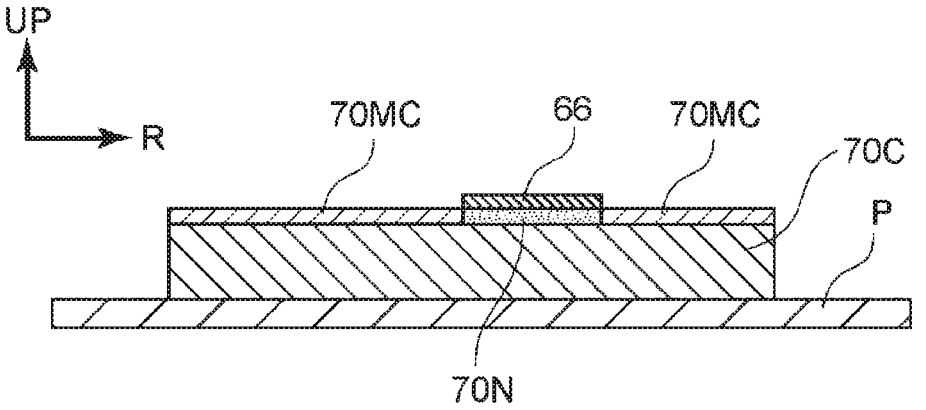

As illustrated in FIG. 6B, in the case where the surface shape of the foil layer 66 of the foil sheet 50, which is used in the foil fixing unit 48, is smoother than the surface shape of the upper roller of the second fixing device 60, a clear toner layer with low gloss (70MC) is formed on a portion of the color toner layer on which the foil layer 66 is not formed. As a result, increase in the gloss of the image that is formed is suppressed.

In the case where the surface shape of the foil layer 66 of the foil sheet 50, which is used in the foil fixing unit 48, is rougher than the surface shape of the upper roller of the second fixing device 60, a clear toner layer with high gloss is formed on the color toner layer. As a result, decrease in the gloss of the image that is formed is suppressed.

Other Exemplary Embodiments

Although the image forming apparatuses according to the exemplary embodiments have been described above, it is obvious that the present disclosure may be implemented in various aspects within the gist of the present disclosure.

Figure 7A:
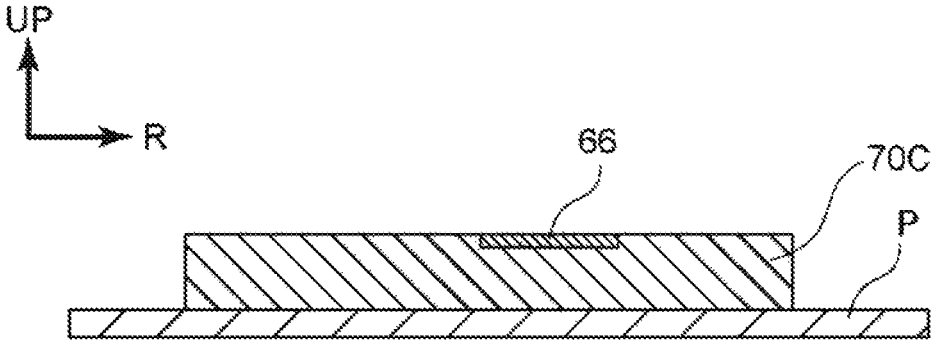
RELATED ART FIG. 7A
FIGS. 7A and 7B are side views each schematically illustrating a foil-printed image that is formed in an image forming apparatus according to a comparative example.
Figure 7B:
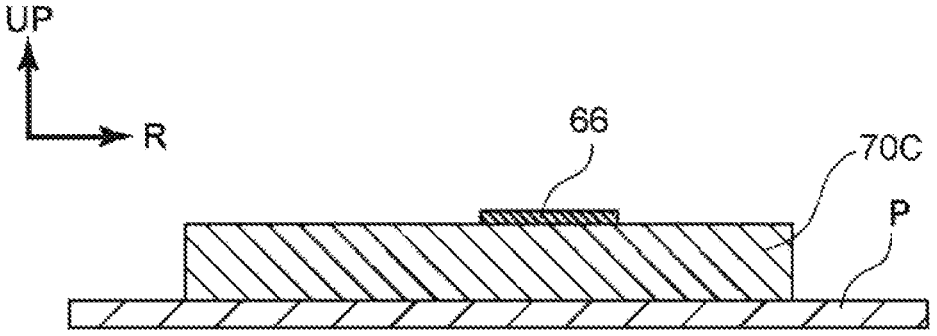
RELATED ART FIG. 7B

For example, FIG. 7A illustrates an example of how a formed foil-printed image is formed. As illustrated in FIG. 7A, in the case where the foil layer 66 and the peripheral toner layer are at the same level in the formed foil-printed image, it is less likely to provide an uncomfortable feeling due to the difference between the foil-printed image portion and the other image portions to a viewer. In contrast, as illustrated in FIG. 7B, in the case where the foil layer 66 is placed on a color toner layer (in the present exemplary embodiment, the cyan toner layer 70C is illustrated in FIG. 7B as an example of the color toner layer), so that an image is formed such that the height thereof is increased by an amount equal to the height of the foil layer 66 from the color toner layer, a viewer may have an impression that the foil-printed image portion stands out in an embossed manner from the peripheral toner layer.

Figure 8A:
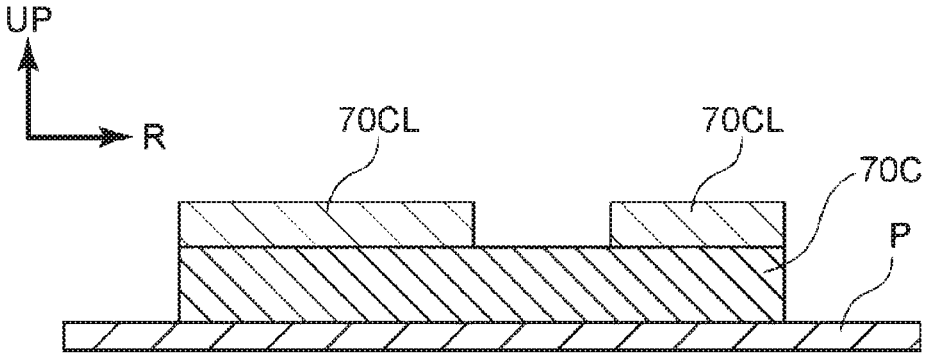
FIGS. 8A and 8B are side views each schematically illustrating a foil-printed image that is formed in an image forming apparatus according to another exemplary embodiment.
Figure 8B:
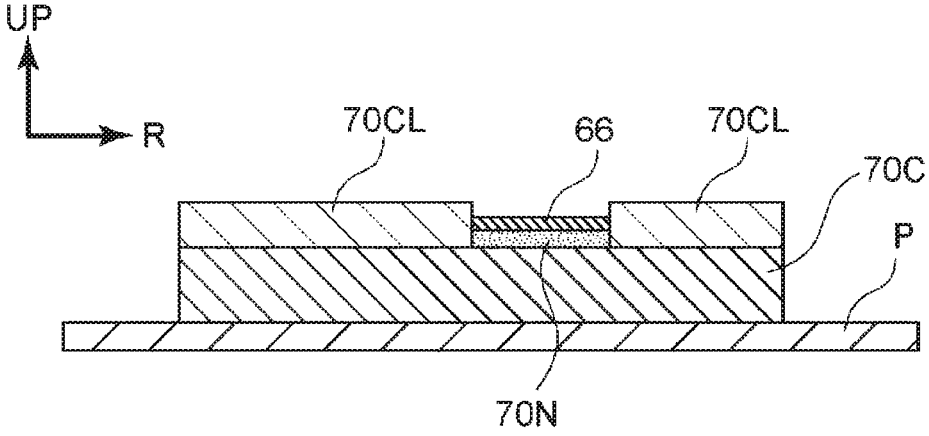

Accordingly, as illustrated in FIG. 8A, before the foil-printed image is formed, the clear toner layer 70CL may be formed onto the color toner layer excluding a portion of the color toner layer where a foil-printed image is to be formed such that the clear toner layer 70CL has a height larger than that of the foil layer 66 or such that the clear toner layer 70CL has a height equal to that of the foil layer 66.

In the first exemplary embodiment, the foil sheet 50 may be formed to have an endless loop shape and may have a structure whereby the foil sheet 50 is delivered from the collecting roller 58 to the feed roller 52.

In addition, in each of the exemplary embodiments, the image forming section 41, the adhesive-toner supply unit 43, and the foil fixing unit 48 are integrated with one another so as to form the image forming apparatus 10. However, the image forming section 41, the adhesive-toner supply unit 43, and the foil fixing unit 48 may be provided separately from one another.

For example, only the foil-printed image forming apparatus 42 including the adhesive-toner supply unit 43 and the foil fixing unit 48 that are integrated with each other may be provided independently of the image forming section 41. With such a configuration, a foil-printed image may be formed on a fundamental image that is formed by a general-purpose image forming apparatus that employs an electrophotographic system.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a first image forming unit configured to form a first toner layer on a medium on which an image is to be formed;

a foil layer forming unit configured to form a foil layer on the first toner layer;

a second image forming unit configured to form a second toner layer below the foil layer in such a manner as to compensate for image steps that are formed by the first toner layer; and a third image forming unit configured to form a third toner layer on a position above the first toner layer and the second toner layer and below the foil layer by using a toner having a melting point lower than a toner that is used for forming the first toner layer and lower than a toner that is used for forming the second toner layer.

2. The image forming apparatus according to claim 1, wherein the second image forming unit is configured to form the second toner layer on the first toner layer by using a toner having a melting point lower than a melting point of a toner that is included in the first toner layer.

3. The image forming apparatus according to claim 1, wherein the second image forming unit is configured to form the second toner layer by using a clear toner with lower gloss than the first toner layer on a portion of the first toner layer on which the foil layer is not formed.

4. The image forming apparatus according to claim 3, wherein the second image forming unit is configured to form the second toner layer by using a clear toner on a portion of the first toner layer on which the foil layer is not formed in such a manner that the second toner layer that has been fixed in place has a height larger than a height of the foil layer.

5. The image forming apparatus according to claim 1, wherein the second image forming unit is configured to form the second toner layer by using a clear toner on a portion of the first toner layer on which the foil layer is not formed in such a manner that the second toner layer that has been fixed in place has a height larger than a height of the foil layer.

6. An image forming apparatus comprising:

a first image forming means for forming a first toner layer on a medium on which an image is to be formed;

a foil layer forming means for forming a foil layer on the first toner layer; and a second image forming means for forming a second toner layer below the foil layer in such a manner as to compensate for image steps that are formed by the first toner layer, wherein the second image forming means is for forming the second toner layer below the first toner layer on the medium.

7. An image forming apparatus comprising:

a first image forming unit configured to form a first toner layer on a medium on which an image is to be formed;

a foil layer forming unit configured to form a foil layer on the first toner layer; and a second image forming unit configured to form a second toner layer below the foil layer in such a manner as to compensate for image steps that are formed by the first toner layer, wherein the second image forming unit is configured to form the second toner layer below the first toner layer on the medium.

8. The image forming apparatus according to claim 7, wherein the second image forming unit is configured to form the second toner layer by using white toner.

* * * * *